United States Patent [19]

Yamashita

[11] Patent Number: 4,817,487

[45] Date of Patent: Apr. 4, 1989

[54] STRUCTURE OF FALL BOARD ASSEMBLY OF KEYBOARD INSTRUMENT

[75] Inventor: Noboru Yamashita, Shizuoka, Japan

[73] Assignee: Yamaha Corporation, Hamamatsu, Japan

[21] Appl. No.: 190,397

[22] Filed: May 5, 1988

[30] Foreign Application Priority Data

May 6, 1987 [JP] Japan ..... 62-67993[U]

[51] Int. Cl.[4] ..... G10C 3/02

[52] U.S. Cl. ..... 84/179

[58] Field of Search ..... 84/178, 179, 180, 181

[56] References Cited

U.S. PATENT DOCUMENTS 503,822 8/1893 Yuel ..... 84/178

FOREIGN PATENT DOCUMENTS 51075 3/1890 Fed. Rep. of Germany ..... 84/178

*Primary Examiner*—L. T. Hix

*Assistant Examiner*—Brian W. Brown

*Attorney, Agent, or Firm*—Burns, Doane, Swecker & Mathis

[57] ABSTRACT

For preventing a fall board of a keyboard instrument from crashing against a key slip of the keyboard instrument, there is disclosed a fall board assembly comprising (a) a fall board having a boss portion and a covering plate portion extending from the boss portion and (b) a pair of rotary dampers provided between the boss portion of the fall board and side arms of the keyboard instrument, respectively, and operative to allow the fall board to move between first and second angular positions, and the keyboard is covered with the covering plate portion of the fall board in the first angular position but exposed to a player in the second angular position, wherein the rotary dampers produce a damping effect against the rotation of the fall board when the fall board rotates from the second angular position to the first angular position.

11 Claims, 6 Drawing Sheets

PRIOR-ART

PRIOR-ART

STRUCTURE OF FALL BOARD ASSEMBLY OF KEYBOARD INSTRUMENT

FIELD OF THE INVENTION

This invention relates to a keyboard instrument such as, for example, a piano and, more particularly, to a fall board assembly falling on the keyboard for covering thereof.

BACKGROUND OF THE INVENTION

A typical example of the fall board assembly provided in a piano like keyboard instrument is illustrated in FIG. 1 of the drawings and largely comprises a fall board 1 provided between two side arms one of which is indicated by phantom line 2, two sets of pivotal units each consisting of a fall board pivot 3 attached to each of the side surfaces of the fall board 1 and a fall board pivot plate 4 attached to each of the side arms and balancing weight 5 attached to the fall board 1 in spacing relation from the fall board pivot 3. The fall board 1 thus arranged is driven for rotation about the center axes of the fall board pivots and positioned into a closed state or an open state. When the fall board 1 is positioned from the closed state into the open state as shown in FIG. 1, the keyboard consisting of a plurality of keys 6 are exposed to a player, thereby being ready for performance.

The fall board assembly illustrated in FIG. 1 has the balancing weight 5 urging the fall board 1 to the open state, so that the fall board 1 tends to keep the open state against a moment due to the weight thereof even if the fall board 1 slightly loses the balance. Moreover, the fall board 1 is prevented from rapid falling and slowly rotates toward the closed state by virtue of the balancing weight 5.

FIG. 2 shows another example of the fall board assembly which largely comprises a fall board 11 formed with two generally crescent-shaped slots one of which is designated by reference numeral 12, two sets of pivotal units 13 allowing the fall board to be rotatable about the center axes thereof, and two leaf springs 14 fixed at the rear end portions thereof to a pair of key blocks 15 and inserted into the generally crescent-shaped slots 12, respectively. The leaf springs 14 are in contact with the respective lower surfaces 16 partially defining the generally crescent-shaped slots 12, respectively, and urge the fall board 1 to be driven for rotation toward the open state thereof, so that the fall board slowly rotates toward the closed state when pulling down by virtue of the resilient force of the leaf springs 14.

However, a problem is encountered in each prior-art fall board assembly in insufficient absorption of force at the final stage of rotation of the fall board. This is because of the fact that the counter moment applied to the fall board due to the weight 5, or the leaf spring 16 is substantially constant over the rotation of the fall board. Namely, if a relatively small counter moment is applied to the fall board for easy pulling motion at the initial stage, the fall board should be strongly supported by a player at the final stage of the rotation for preventing the fall board from crashing against the key slip. The fall board assembly equipped with the leaf springs 14 has an additional problem in complex assembly, because the pivotal units and the leaf springs should be simultaneously assembled.

SUMMARY OF THE INVENTION

It is therefore an important object of the present invention to provide a fall board assembly which is easy for pulling motion at the initial stage of the rotation and produces a sufficient absorption at the final stage of the rotation.

It is another important object of the present invention to provide a fall board assembly which is applied with a counter moment even if the key board assembly is positioned in the open state.

It is still another object of the present invention to provide a fall board assembly which is easy for assembly.

To accomplish these objects, the present invention proposes to vary the counter moment from the initial stage of the rotation to the final stage of the rotation.

In accordance with the present invention, there is provided a fall board assembly used for a keyboard instrument having a keyboard located between a pair of side arms, comprising (a) a fall board having a boss portion and a covering plate portion extending from the boss portion, and (b) a pair of rotary dampers provided between the boss portion of the fall board and the side arms, respectively, and operative to allow the fall board to move between first and second angular positions, the keyboard being covered with the covering plate portion of the fall board in the first angular position but exposed to a player in the second angular position, wherein the rotary dampers produce a damping effect when the fall board rotates from the second angular position to the first angular position.

Each of the dampers may comprise a casing embedded into a cavity open at each of side surfaces of the boss portion, a pivot member rotatably supported by the casing and partially projecting from the casing so as to fixedly supported by each of the side arms, and an elastic member engaged at one end thereof with the casing and at the other end thereof with the pivot member in such a manner as to produce the damping effect, and the elastic member may be formed by a helical spring.

In one embodiment, the helical spring has a plurality of helix elements winding the pivot member and including a first helix element and a final helix element, and the final helix element has a protrusion capable of being in contact with a side wall defining a groove formed therein. In order to produce a counter moment varied from the second angular position to the first angular position, the helical spring may wind the pivot member from the first helix element to the final helix element in a direction identical with a rotational direction of the fall board from the second angular position to the first angular position, and one end of the spring engages with the casing while the other end of the spring is fixed at the pivot member. If the counter moment produced by the rotary damper is insufficient, the fall board assembly may further comprise a weight member attached to the boss portion of the fall board.

BRIEF DESCRIPTION OF THE DRAWINGS

The features and advantages of a fall board assembly according to the present invention will be more clearly understood from the following description taken in conjunction with the accompanying drawings in which.

DESCRIPTION OF THE PREFERRED EMBODIMENT

Figure 1:
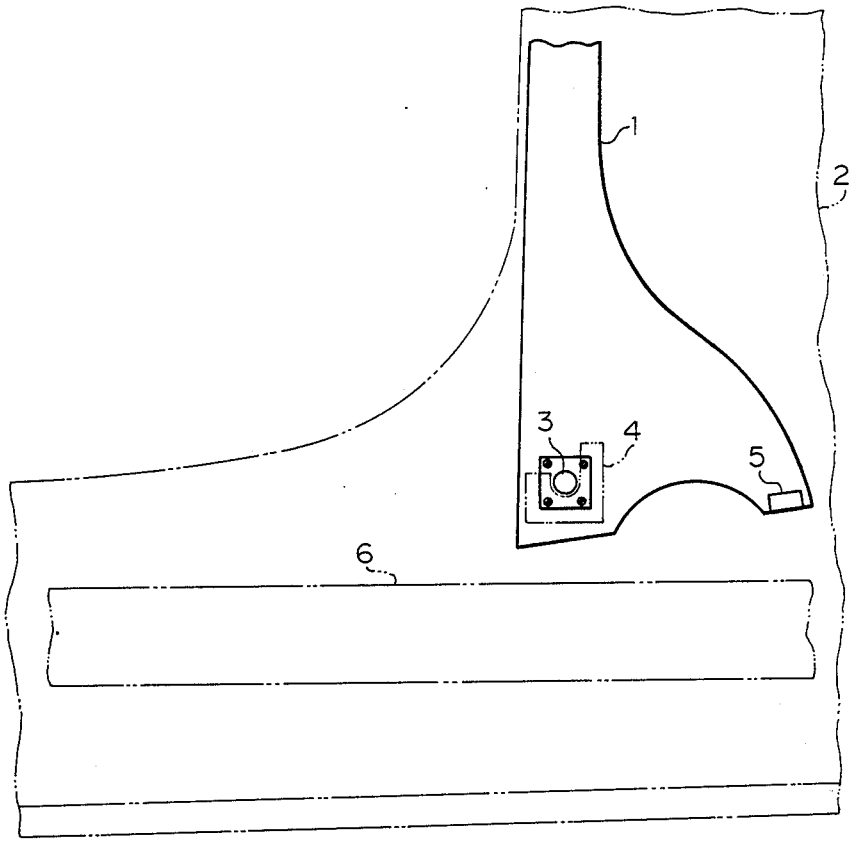
FIG. 1 is a side view showing a part of a prior-art fall board assembly provided in a piano like keyboard instrument and equipped with a balancing weight for producing a constant counter moment.
Figure 2:
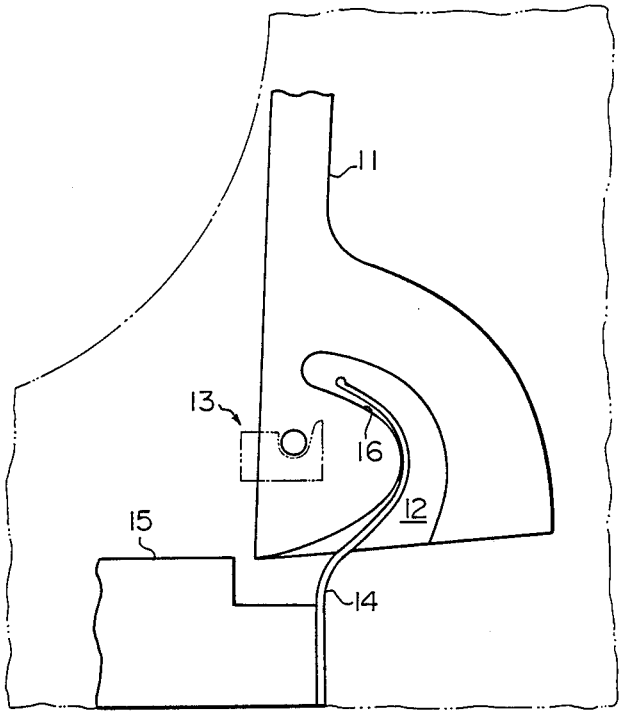
FIG. 2 is a side view showing a part of another prior-art fall board assembly equipped with a leaf spring for producing a constant counter moment.
Figure 3:
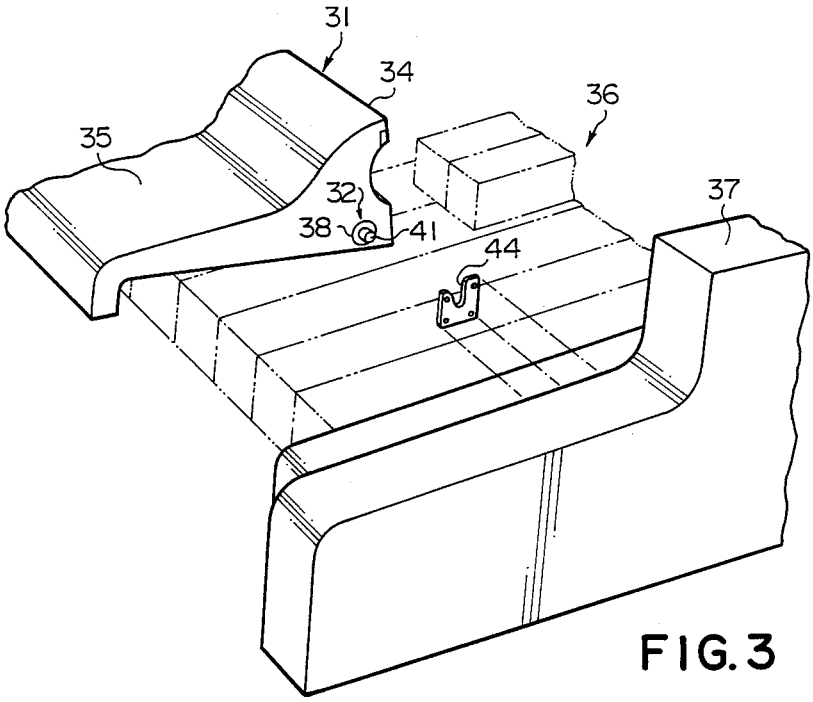
FIG. 3 is a perspective view showing a part of a fall board assembly embodying the present invention.
Figure 4:
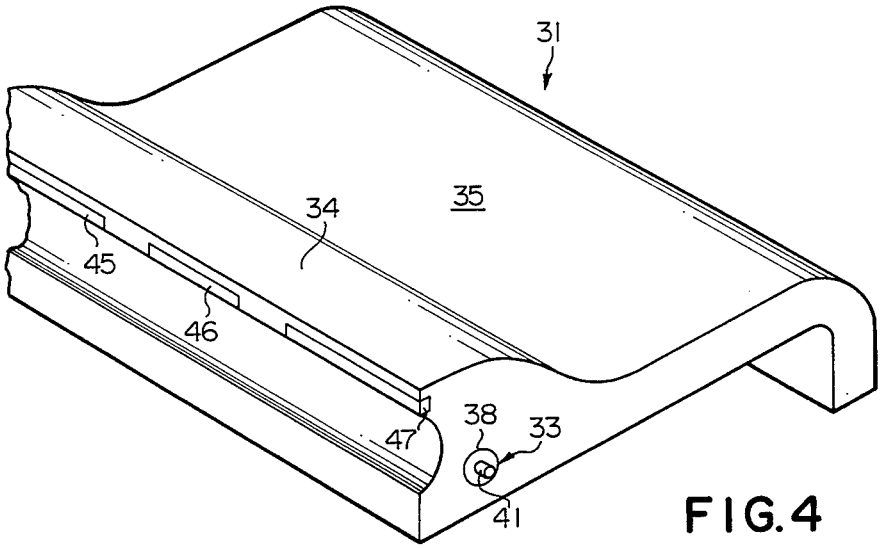
FIG. 4 is a perspective view showing, to an enlarged scale, the part of the fall board assembly illustrated in FIG. 3 from a different angle.
Figure 5:
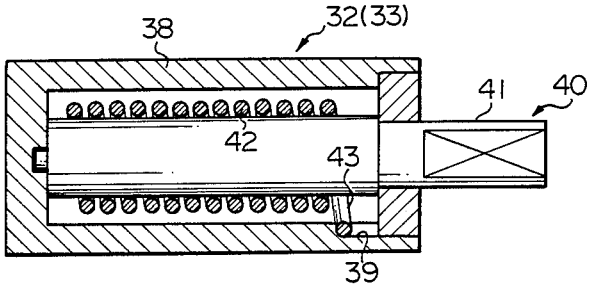
FIG. 5 is a cross sectional view showing an embodiment of a rotary damper unit incorporated in the fall board assembly illustrated in FIG. 3.

Referring first to FIGS. 3 and 4 of the drawings, there is shown a part of a fall board assembly embodying the present invention. The fall board assembly is incorporated in a keyboard musical instrument such as, for example, an acoustic piano and largely comprises a fall board 31 and two rotary damper units 32 and 33. The fall board 31 has a boss portion 34 relatively large in thickness and a covering plate portion 35 relatively small in thickness and extending from the boss portion 34, and the covering plate portion 35 has a curved end so as to be brought into contact with a key slip (not shown) without physical contact with a keyboard 36 consisting of a plurality of keys. The boss portion 34 has both side surfaces where cylindrical cavities are open, and the cylindrical cavities deviate from the central zone thereof. The two rotary dampers 32 and 33 respectively intervene between the fall board 31 and two side arms (one of which is designated by reference numeral 37), so that the fall board is rotatable about the center axes of the rotary dampers 32 and 33 and positioned between an open state and a closed state. In the closed state the keyboard 36 is covered by the covering plate portion 35 of the fall board 31 but is exposed to a player if the fall board 31 is positioned into the open state. In the following description, a rotational direction from the open state to the closed state is referred to as a fall direction or a close direction for the sake of simplicity.

Each of the rotary dampers 32 and 33 comprises a cylindrical casing 38 snugly inserted into each cavity formed in the boss portion 34 of the fall board 31 and formed with a groove 39, a pivot member 40 rotatably supported at the rear-end and the intermediate portions thereof by the casing 38 and having a projecting leading end portion 41, and a helical or coil spring 42 having a plurality of helix elements and a lug portion 43 or a protrusion movably inserted into the groove 39. In this instance, the helical spring 42 is not fixed to the pivot member 40 but slidably engaged with the pivot member 40, and the groove 39 extends over about 45 degrees in the circumferential direction of the casing 38. Then, the lug portion 43 is freely movable in the groove 39 over 45 degrees. The helical spring 42 winds the pivot member 40 in the fall direction toward the lug portion 43 when the fall board assembly is installed in the keyboard instrument. The leading end portion 41 has two parallel flat surfaces which are in contact with a bifurcated end portion of one of pivot plates 44, and the pivot plates 44 are fixed to the side arms, respectively. Though not clearly shown in the drawings, a silicon oil or a grease is applied between the casing 38 and the pivot member 40. The rotary dampers 32 and 33 thus arranged allow the fall board 31 to turn in the open direction without producing any substantial damping effect, however apply a damping effect to the fall board 31 when the fall board 31 is turned in the close direction.

In this instance, balancing weights 45, 46 and 47 are embedded into the boss portion 34 of the fall board 31 in such a manner as to be spaced apart from the cavities in the direction of thickness of the fall board 31. Then, a counter moment takes place in the open direction at all times, and, for this reason, the fall board 31 is kept in stable in the open state even if the balance is slightly loses. These balancing weights 45 to 47 are further conducive to reduction in size of the rotary dampers 32 and 33 because a relatively thin helical spring is enough to produce the damping effect. This results in reduction in occupation area of each rotary damper 32 or 33, which is easy for installation of the rotary dampers in the fall board 31.

Figure 6:
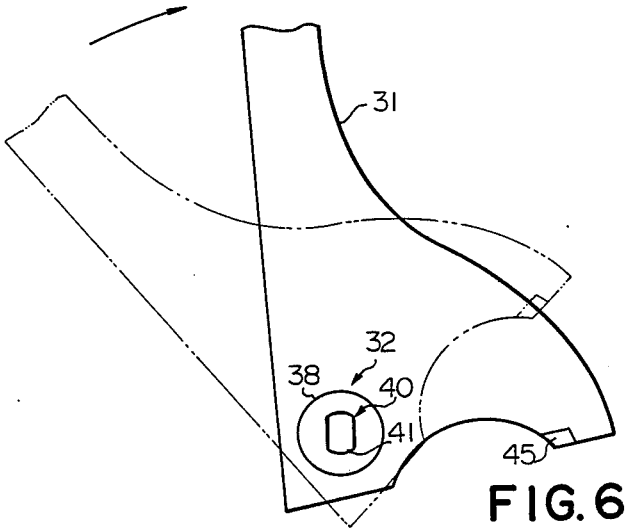
FIG. 6 is a side view of the fall board assembly illustrated in FIG. 3 in an angular position.
Figure 7:
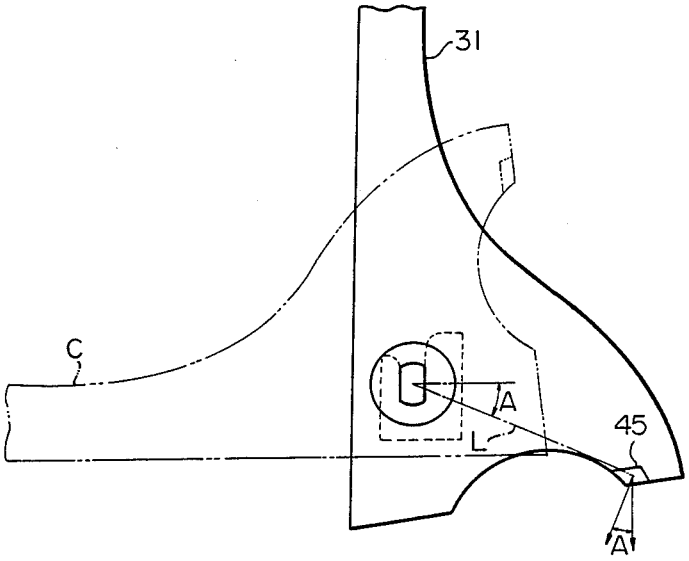
FIG. 7 is a side view of the fall board assembly illustrated in FIG. 3 in a different angular position from that in FIG. 6.

Description will be hereinunder made for the function of the fall board assembly focusing upon the rotary dampers with reference to FIGS. 6 and 7 of the drawings. When the fall board 31 travels from the closed state to the open state as illustrated in FIG. 6, the casing 38 is driven for rotation about the center axes of the pivot members in the open direction, so that the helical spring 42 of each rotary damper 32 or 33 slides over the outer surface of the pivot member 40 without being subjected to any substantial friction except for the resistance due to the viscosity, thereby allowing the fall board 31 to turn without any damping effect. The balancing weights 45 to 47 produce the additional counter moment identical in direction with the moment applied to the fall board 31 by a player, then the fall board 31 is easily turned and positioned into the open state. The balancing weights 45 to 47 deviate from the center axes of the pivot members by a distance L as described hereinbefore, so that the counter moment calculated as $L \times W \cos A$ (where W is the total amount of weight of the balancing weights 45 to 47) is applied to the fall board 31 positioned in the open state as shown in FIG. 7. If the distance L, the angle A and the total weight are selected to be large enough to cancel undesirable moment urging the fall board in the close direction due to, for example, vibrations during a performance, the fall board 31 continues to stay in the open state without losing the balance.

On the other hand, when the player pulls down the fall board 31 so as to cover the keyboard 36, the casing 38 is turned in the fall direction, however the lug portion 43 travels in the groove 39 during the initial stage of the rotation over 45 degrees without producing any twist in the helical spring 42. Then the player easily begins to turn the fall board 31 with a relatively small moment. However, the counter moment produced by the balancing weights 45 to 47 is exerted on the fall board 31 against the weight of the fall board 31, and this is conducive to easy pull motion of the fall board 31. When the fall board 31 excesses about 45 degrees, the lug portion 43 is brought into contact with the side wall partially defining the groove 39, so that the helical spring 42 is twisted in the close direction, thereby causing the helix elements to be decreased in diameter. The helix elements begin to press the pivot member of each rotary damper 32 or 33, and this results in increasing of the friction between the helical spring 42 and the pivotal member 40. At the final stage of the rotation, the helical spring 42 almost grips the pivot member with substantial friction, so that the fall board 31 is softly positioned into the closed state as indicated by phantom line C in FIG. 7 of the drawings.

As will be understood from the foregoing description, the fall board assembly according to the present invention is easily turned by the player with a relatively small moment at the initial stage and softly positioned into the closed state by virtue of the absorption of the rotary dampers. The fall board assembly according to the present invention is further advantageous over the prior-art illustrated in FIG. 3 in stability in the open state because of the additional counter moment produced by the balancing weights.

Figure 8:
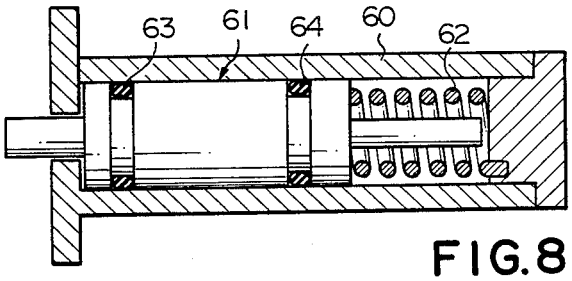
FIG. 8 is a fragmentary cross sectional view showing another rotary damper.

Turning to FIG. 8 of the drawings, the structure of another rotary damper is illustrated and largely comprises a cylindrical casing 60, a rod member 61 rotatably supported by the casing 60, a coil spring 62 connected at one end thereof to the casing 60 and at the other end thereof to the rod member 61, and two oil seals 63 and 64. The rod member 61 has an intermediate portion larger in diameter than front and rear end portions, and a cylindrical gap takes place between the intermediate portion and the casing 60. The gap is filled with a high-viscosity material so that a friction takes place between the casing 60 and rod member 61 due to the high-viscosity material.

In operation, when the fall board is turned from the open state, the coil spring 62 produces a counter moment different in direction to the rotation of the fall board. However, the fall board reaches the closed position, then the friction between the casing 60 and the rod member 61 is larger in value than the resiliency due to the coil spring 62, thereby applying the rapid brake to the fall board.

Although particular embodiment of the present invention have been shown and described, it will be obvious to those skilled in the art that various changes and modifications may be made without departing from the spirit and scope of the present invention.

What is claimed is:

1. A fall board assembly for use in a keyboard instrument having a keyboard located between a pair of side arms, comprising:

(a) a fall board having a boss portion and a covering plate portion extending from the boss portion; and (b) a pair of rotary dampers provided between the boss portion of said fall board and said side arms, respectively, and operative to allow the fall board to move between first and second angular positions, said keyboard being covered with the covering plate portion of said fall board in said first angular position but exposed to a player in said second angular position, wherein said rotary dampers produce a damping effect against the rotation of the fall board when said fall board rotates from said second angular position to said first angular position.

2. A fall board assembly as set forth in claim 1, in which said fall board assembly further comprises a weight member attached to the boss portion of said fall board and producing a counter moment in direction to facilitate said damping effect.

3. A fall board assembly as set forth in claim 1, in which each of said dampers comprises a casing embedded into a cavity open at each of side surfaces of said boss portion, a pivot member rotatably supported by the casing and partially projecting from the casing so as to be fixedly supported by each of said side arms, and an elastic member engaged at one end thereof with the casing and at the other end thereof with the pivot member in such a manner that a biasing force of the elastic member acting on the pivot member is increased when said fall board rotates from said second angular position and said first angular position.

4. A fall board assembly as set forth in claim 3, in which said elastic member is formed by a helical spring.

5. A fall board assembly as set forth in claim 4, in which said helical spring has a plurality of helix elements winding said pivot member and including a first helix element and a final helix element and in which said final helix element has a protrusion capable of being in contact with said casing.

6. A fall board assembly as set forth in claim 5, in which said casing has a side wall defining a groove formed therein and in which said protrusion is movably inserted into the groove of said casing.

7. A fall board assembly as set forth in claim 6, in which said helical spring winds said pivot member from said first helix element to said final helix element in a direction identical with a rotational direction of said fall board from said second angular position to said first angular position.

8. A fall board assembly as set forth in claim 7, in which said helix elements loosely wind said pivot member in said second angular position and in which said helix elements substantially grip said pivot member in said first angular position.

9. A fall board assembly as set forth in claim 8, in which said side arms have a pair of pivot plates each having a bifurcated end portion for fixedly supporting said pivot member.

10. A fall board assembly as set forth in claim 9, in which said fall board assembly further comprises a balancing weight attached to the boss portion of said fall board in spacing relation with said rotary dampers.

11. A fall board assembly for use in a keyboard instrument having a keyboard located between a pair of side arms each provided with a pivot plate, comprising:

(a) a fall board having a boss portion and a covering plate portion extending from the boss portion;

(b) a pair of rotary dampers provided between the boss portion of said fall board and said pivot plates, respectively, and operative to allow the fall board to move between first and second angular positions, said keyboard being covered with the covering plate portion of said fall board in said first angular position but exposed to a player in said second angular position; and (c) balancing weight means attached to the boss portion of said fall board in spacing relation with said rotary dampers for producing an additional moment urging the fall board toward said second angular position, wherein each of said dampers comprises a casing embedded into a cavity open at each of side surfaces of said boss portion, a pivot member rotatably supported by the casing and partially projecting from the casing so as to be fixedly supported by each of said pivot plates, and a helical spring having a plurality of helix elements winding said pivot member and an end engaged by said casing while the other end engaged by said pivot member, said helix elements winding in a direction identical with a rotational direction of said fall board from said second angular position to said first angular position, thereby allowing said helix elements to produce a spring force against the rotational movement of the fall board toward said first position.

* * * * *